United States Patent [19]

Kaltenegger

[11] 4,343,568

[45] Aug. 10, 1982

[54] ROAD GRADING AND TAMPING APPLIANCE

[76] Inventor: Benno Kaltenegger, Via Rasc 2a, Capione near Lugano, Italy

[21] Appl. No.: 205,323

[22] PCT Filed: Dec. 7, 1979

[86] PCT No.: PCT/EP79/00097

§ 371 Date: Aug. 11, 1980

§ 102(e) Date: Jun. 10, 1980

[30] Foreign Application Priority Data

Dec. 11, 1978 [CH] Switzerland ..... 12584/78

[51] Int. Cl.[3] ..... E01C 19/38

[52] U.S. Cl. ..... 404/133; 404/116; 404/114

[58] Field of Search ..... 404/133, 113, 112, 116, 404/114, 117

[56] References Cited

U.S. PATENT DOCUMENTS

| | | | |
|---|---|---|---|
| 2,061,943 | 11/1936 | Jorgensen | 404/116 X |
| 2,223,024 | 11/1940 | Beierlein | 404/113 |
| 2,400,341 | 5/1946 | Day | 404/113 |
| 2,411,317 | 11/1946 | Day | 404/113 |
| 2,740,336 | 4/1956 | Degen | 404/113 |
| 2,828,676 | 4/1958 | Steuerman | 404/113 |
| 2,917,979 | 12/1959 | Denning | 404/112 |
| 3,673,931 | 7/1972 | Dening | 404/133 |

FOREIGN PATENT DOCUMENTS

| | | |
|---|---|---|
| 870969 | of 1949 | Fed. Rep. of Germany . |
| 1275316 | of 0000 | Fed. Rep. of Germany . |

*Primary Examiner*—Nile C. Byers, Jr.

*Attorney, Agent, or Firm*—Frishauf, Holtz, Goodman & Woodward

[57] ABSTRACT

The road grading and tamping appliance (1) has a bottom plate (2) and at least one rotating, eccentrically-supported and driven weight for providing vibration. The bottom plate (2) is provided with a shaft (5) disposed perpendicular thereto and on which the rotating eccentric weight (10) is rotatably supported, specifically at a predetermined distance from the bottom plate (2). The eccentric weight (10) consequently rotates in a plane parallel to the bottom plate. By adjustment of the rotating eccentric weight (10) axially of the vertical shaft (5), the eccentric action, that is the leverage action, on the bottom plate (2) can be reduced or increased.

14 Claims, 4 Drawing Figures

ROAD GRADING AND TAMPING APPLIANCE

The invention relates to a road grading and tamping appliance with a bottom plate and a revolving, driven and eccentrically-supported centrifugal weight.

Background various constructions of road grading and tamping appliances and known in which an eccentrically-supported weight is kept in rotation. In road rollers with roller cylinders rotating about an axle, the eccentrically-supported weights rotate about the axle of the drums, that is about a horizontal axle. Other types of road grading and tamping appliances which are equipped with one bottom plate or a plurality of bottom plates have vibratory device so designed that the eccentric weights are supported on a horizontal axle shaft. In both cases the centrifugal force of the eccentric weights, or the conforming components of same, takes effect, with level ground surface subjected to compaction, in the direction perpendicular to that surface. The centrifugal force of the eccentric weight is greatest when the eccentric weights are vertical in the lower or upper position. In each other position of the eccentric weights only components of the action of force in the downwards or upwards verticals are operative. This means that only a small component of the eccentric rotating weights can be used for the compaction of the ground.

THE INVENTION

It is an object to provide a road grading and tamping appliance in which the rotating eccentric weight can be fully used for the compaction of the ground.

In accordance with the invention the bottom plate has arranged perpendicular thereto a shaft which is provided with an eccentric weight or a plurality of eccentric weights in a plane situated parallel to the bottom plate and at a distance from the latter.

In the case of such a road grading and tamping appliance, a which the eccentric weight or mass is arranged horizontally on a vertical shaft, the eccentric rotating weight is operative in a horizontal plane. As this so-supported eccentric weight is operative at a predetermined distance from the bottom plate, a lever force is applied via the vertical shaft or axle of the road grading and tamping appliance. The bottom plate is tipped, or tilted into a rocking position, continuously all around, and thereby performs a wobbling motion by tilting the bottom plate in a circular orbit as the mass rotates. The ground is consolidated or compacted in this region through this wobbling motion of the bottom plate. The vertical shaft transmits the moment produced above to the bottom plate in like manner, so that a consolidation of the ground is accomplished through the constant wobbling motion of the bottom plate. This consolidation or compaction takes place rapidly all round, that is the energy of the eccentric weight is constantly converted into ground compaction or compression work. With increasing compaction of the ground the vibration or the wobble effect of the road grading and tamping appliance is reduced and this serves as an indication of compaction being completed. One eccentric weight only is sufficient in the case of the road grading and tamping appliance in accordance with the invention.

According to a further feature of the invention, the rotating eccentric weight can be adjusted in the axial direction of the vertical shaft. In that way the lever action or the moment is reduced or increased as a function of the length of the lever arm, and this signifies a reduction or increase of the compaction work. Moreover the rotational speed of the rotating weight may be modified. In particular the road grading and tamping appliance may be so formed that there is rigidly connected with the bottom plate a casing in which is supported for rotation the shaft disposed vertically to the bottom plate. The rotating eccentric weight is arranged displaceable along the shaft and can be adjusted the locked by means of an operating device movable along a casing guideway, for example a slot. There may be joined with eccentric weight a sleeve-adjacent piece which supports a roller bearing. The operating device may with this engage by means of a forked end piece or the like the outer ring of the roller bearing.

The casing is preferably surrounded by a casing jacket, radially and axially disposed resilient shock-absorbing members being arranged between the casing and the casing jacket. The casing jacket is preferably provided with a pole, which is interchangeably fitted thereon. to cause traveling of the road grading and tamping appliance.

The bottom plate preferably has a plane round bottom surface. A slight outwardly-directed camber may also be provided for the bottom surface. A driving device for the shaft may act on the upper end of the vertical shaft through the intermediary of a flexible coupling. This driving device may be a motor of any kind, preferably an internal-combustion engine, an electric motor or the like. The driving device is preferably mounted on the casing jacket.

A plurality of road grading and tamping appliances may be coupled with one another, this being effected, for example, by resilient linkage of the casing jackets. With such a coupling care is to be taken that the speeds of the waves of the road grading and tamping appliances and the rotations of the eccentric weights are synchronized with one another, for example through the intermediary of appropriate gearing and the like.

Embodiments of the invention are hereinafter described in more detail with reference to the accompanying diagrammatic drawings, in which.

Figure 1:
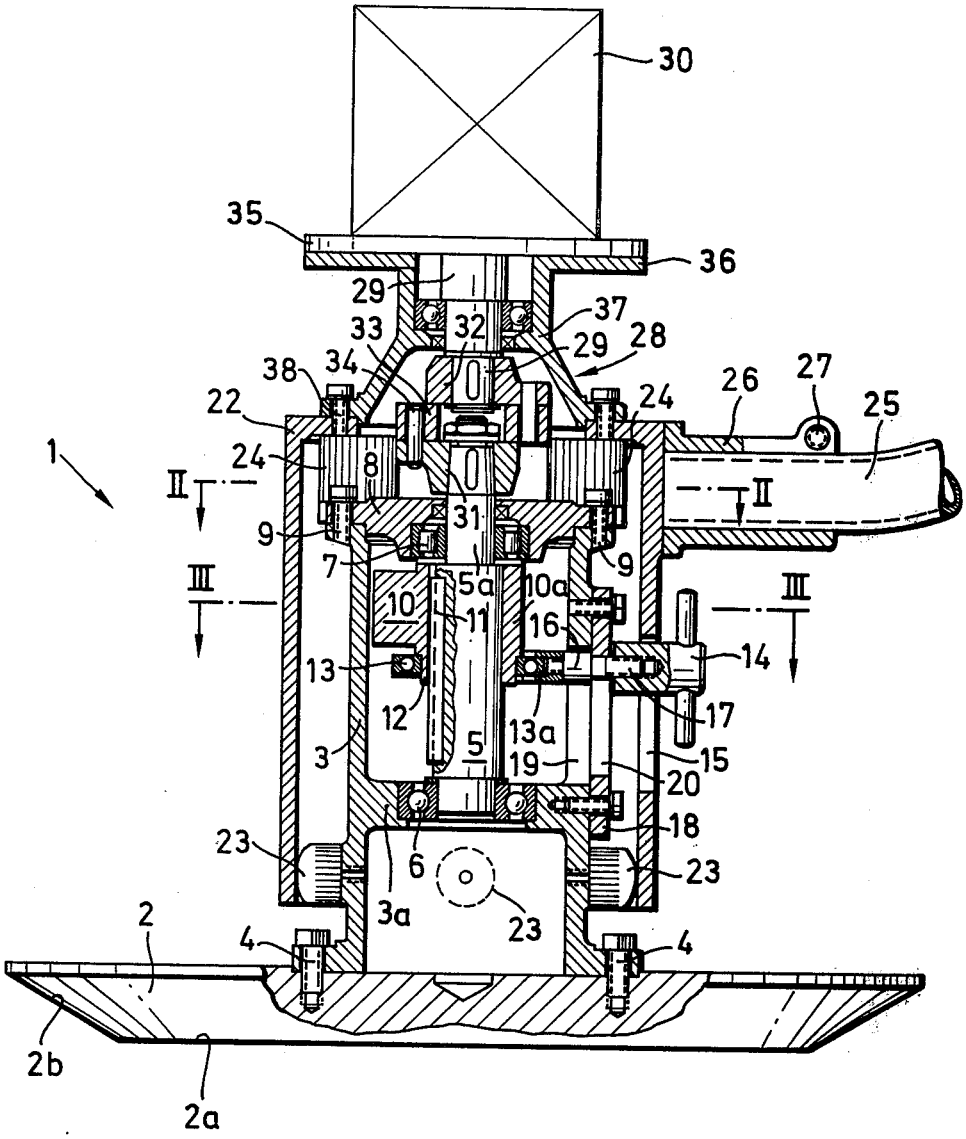
FIG. 1 is a sectional elevation of one embodiment of road grading and tamping appliance in accordance with the invention.
Figure 2:
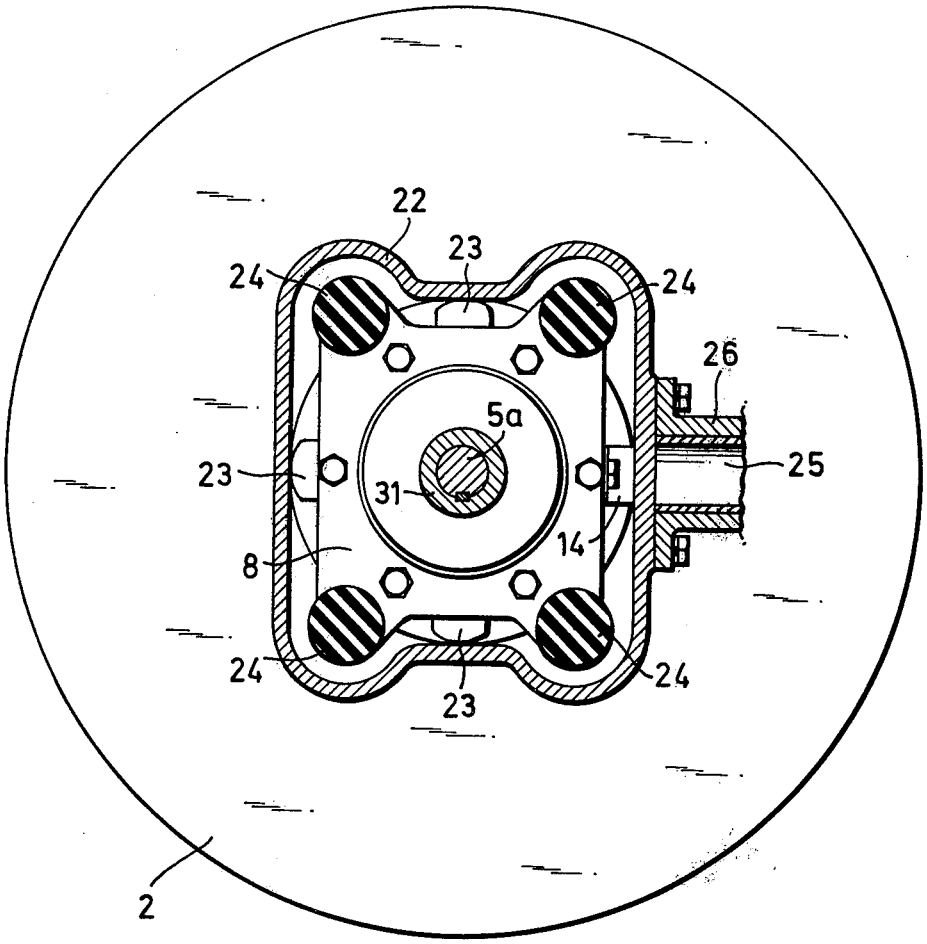
FIG. 2 is a cross-section along the line II—II in FIG. 1.
Figure 3:
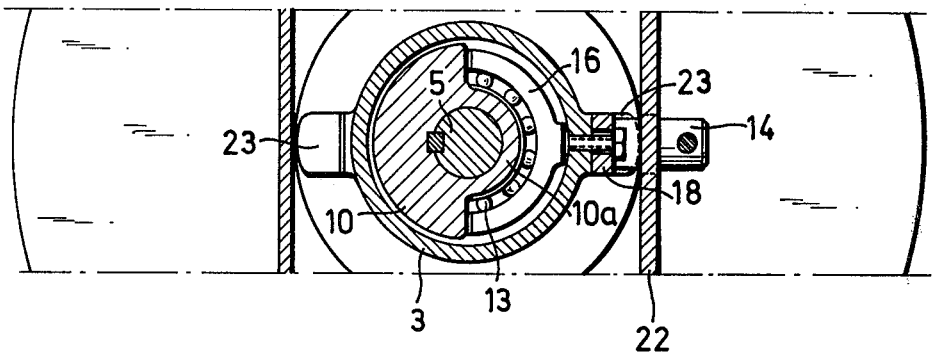
FIG. 3 is a cut-away portion of a cross-section along the line III—III in FIG. 1.

The road grading and tamping appliance 1 includes a bottom plate 2 which—seen in plan (FIG. 2)—represents a circular disk. A casing 3 is fixedly connected with the bottom plate 2 by means of bolts 4. A shaft 5 is rotatable within the casing 3 by means of the roller bearings 6 and 7. The casing 3 is be closed off at its upper end by the cover plate 8. The cover plate 8 is fixedly connected with the casing 3 by the bolts 9. An eccentrically-supported weight 10 is joined on to the shaft 5 for rotation therewith by means of the part 11. The eccentrically-supported weight 10 has a sleeve portion 10*a* (FIG. 3) a sleeve-like extension 12 (FIG. 1) on which a roller bearing 13 is located. An operating element 14, for example a bar, handwheel or the like, is guided through a vertically-extending slot 15 in the wall of the casing 3 and grips with a forked end piece 16 about the outer ring 13*a* of the roller bearing 13. By moving the operating element 14 along the slot 15, the sleeve portion 10*a* with the eccentric weight 10 can be displaced upwardly or downwardly along the shaft 5. The mass 10 is spaced always above the bottom plate—see FIG. 1—by at least its thickness, to provide a suitable lever arm to cause wobble of plate 2. The eccentric weight 10 can be locked at any desired higher level on the shaft 5 by screwing the operating element 14 up on the threaded bolt 17 and tightening it against casing 3. The casing 3 and a plate 18 fronting same are likewise provided with suitable slots 19 and 20.

The casing 3 is surrounded by a casing jacket 22 between which and the casing radially-extending shock-absorbing members 23 are arranged. The casing jacket 22 rests on vertically-arranged shock-absorbing members 24. The casing jacket 22 is fitted with a handle, or pole 25 secured in a sleeve 26 fast with the wall of the casing jacket 22. The handle or pole 25 can be interchangeably inserted onto sleeve 26. The handle, or pole is clamped in the sleeve 26 by a clamping screw 27.

The upper end 5*a* (FIG. 2) of the shaft 5 is connected for rotation driving shaft 29 of a driving motor 30 or the like by a flexible coupling 28 with a. The flexible coupling 28 consists of the bushings 31 and 32 (FIG. 7) together with the resilient intermediary member 33 and the tie bolts 34. The motor 30, for example an internal-combustion engine, an electric motor or the like, is joined through a flange 35 with the flange 36 of the supporting casing 37 which is fixedly connected to the casing jacket 22 by means of the bolts 38. The casing jacket 22 can be turned on the supporting shock-absorbing members 24 by the handle or pole 25, as required.

The bottom plate has a bottom surface 2*a* (FIG. 1) which is in the form of a plane round bearing surface. A bevel 2*b* may be provided at the periphery. The bearing surfaces of the bottom plate may also be slightly cambered. The bottom plate may also have a different shape in plan; for example square, quadrangular and polygonal.

OPERATION

The eccentric weight 10 revolving with the driven shaft 5 sets up a centrifugal force radially in a horizontal plane which, because of the spacing of the eccentric weight from the bottom plate 2—in whatever position is considered—exerts a tilting moment. This moment is also effective on the bottom plate, so that the bottom plate, at the very points at which the eccentric weight is located, is pressed more firmly onto the ground than at the diametrically-opposite points. As the eccentric weight revolves constantly, this tilting moment takes effect all round in rapid sequence. There comes about at the bottom plate an all-round continuous vibration through which the ground is subjected to a compacting action. Travelling of the road grading and tamping appliance in the desired direction can be controlled by slight manipulation of the pole or handle 25. The lever arm with which the centrifugal force is operative on the bottom plate is varied by elevation adjustment of the eccentric weight 10 along the shaft 5. The greater the lever arm, the greater become the moments to be transferred, whereby the performance of the vibratory arrangement can be regulated. It is moreover, possible to modify the rotational speed of the driving shaft, and therewith of the vibratory shaft, by appropriate control of the driving motor. The shock-absorbing members interposed between the casing and the casing jacket suppress any vibration of the pole or handle 25 so that the road grading and tamping appliance can be well managed by hand. The bottom plate is interchangeably arranged on the casing, so that bottom plates of different diameters can be used. The road grading and tamping appliance is structurally compact and is good for work of remarkably great compaction.

Figure 4:
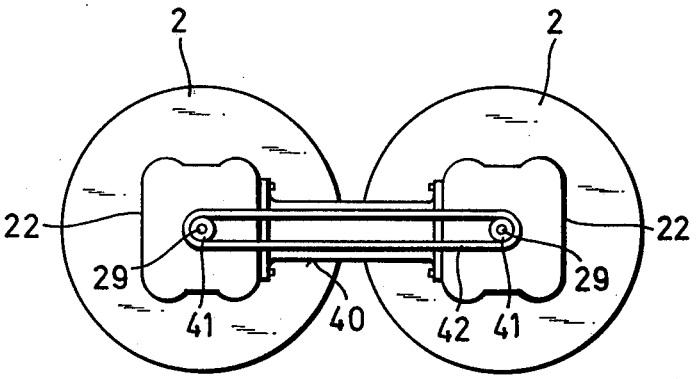
FIG. 4 illustrates the coupling of two road grading and tamping appliances in accordance with the invention.

It is moreover, possible that two or more than two road grading and tamping appliances 1 can be coupled with one another. In so doing, for example, the casing jackets 22 may be kept connected with one another through a rigid or flexible connecting link 40 (FIG. 4), the driving shafts 29 being synchronizable with one another, for example by means of toothed wheels 41 and serrated belts 42. When road grading and tamping appliances are coupled together, superposed vibrations will result through which a compaction power for the ground is also achieved.

I claim:

1. Soil compaction and tamping apparatus having
a bottom plate (2) having an essentially circular bottom surface (2*a*);
a vertical support means (3, 22);
means (4) for securing the vertical support means to the bottom plate;
motor means (30);
and comprising, in accordance with the invention
means for applying a rocking or tilting movement to the bottom plate in a circular orbit of the bottom surface (2*a*) with respect to soil to be compacted comprising a rotatable shaft (5) extending in a vertical direction from at least approximately the center of the bottom plate, and drivingly coupled to the motor means;
and an eccentric weight or mass (10) secured to the rotatable shaft to revolve therewith, at a predetermined height above the bottom plate (2) to generate, upon rotation of the shaft, a force moment acting on the bottom surface of the bottom plate by the lever arm formed by the distance of the weight, or mass above said bottom surface plate and thereby effect said tilting of the bottom plate and wobbling and tilting motion thereof.

2. Apparatus according to claim 1 wherein the revolving eccentric weight or mass (10) is height adjustable in axial direction on the vertical shaft (5).

3. Apparatus according to claim 1 wherein the support means comprises
a hollow casing (3);
the shaft (5) being journalled within the casing;
and adjustable means (14, 16) engaging the casing and coupled to the weight or mass for securing said weight or mass in predetermined, height adjustable position above the bottom
plate to thereby permit adjustment of the length of the lever arm and adjust the force moment of tilt, upon rotation of the eccentric weight or mass being transferred to said bottom plate.

4. Apparatus according to claim 3 wherein said adjustment means comprises a clamp (14) engaging said casing (3) to determine the vertical position of the eccentric weight or mass.

5. Apparatus according to claim 3 wherein said height adjustable eccentric weight or mass (10, 10*a*) includes an extending sleeve (12) vertically extending along the shaft (5);
the adjustable means includes a fork element (16) surrounding said sleeve;

and bearing means (13) interposed between said fork and said sleeve.

6. Apparatus according to claim 1 wherein the support means includes a hollow casing (3), the shaft (5) being journalled within the casing;

a jacket (22) surrounding the casing;

and resilient shock absorbing members (23, 24) positioned radially (23) and axially (24) between the casing (3) and the casing jacket.

7. Apparatus according to claim 6 further including a handle or pole (25);

and means (26, 27) for releasebly and interchangeably attaching said handle or pole (25) to the casing jacket (22) to permit operator control of said apparatus.

8. Apparatus according to claim 1 wherein said motor means (30) is positioned at the upper end of said vertical shaft.

9. Apparatus according to claim 6 wherein said motor means is secured to said casing jacket (22) at the upper end of said shaft (25);

and a flexible coupling (28) is provided, interposed between said motor means and the shaft.

10. Apparatus according to claim 9 further including a support flange (36) secured to the casing (22) adjacent the upper end (5*a*) of the shaft, the motor means (30) being attached to said support flange.

11. Apparatus according to claim 1 wherein the bottom pate (2) has an essentially circular outline, and the bottom surface (2*a*) is circular.

12. Apparatus according to claim 1 wherein the minimum predetermined height of said eccentric weight or mass (10) above the bottom plate is at least as high as the thickness of said weight or mass.

13. Apparatus according to claim 1 wherein said bottom plate has upwardly sloping end portions (2*b*) extending from said bottom surface (2*a*) to an upper surface thereof, the securing means mounting said vertical support means above the upper surface of the bottom plate, and said eccentric weight or mass (10, 10*a*) being positioned within the support means by a distance above the upper surface of at least the thickness of the weight or mass.

14. An assembly or group of soil compacting and tamping apparatus units comprising a plurality of the apparatus according to claim 1;

coupling means including resilient linkages (40) coupling together the support means of the individual apparatus units;

and means (41) coupling together the shafts (5) of the apparatus units to synchronize rotary movement of the eccentric waste or masses (10) of the respective units.

* * * * *

UNITED STATES PATENT AND TRADEMARK OFFICE

CERTIFICATE OF CORRECTION

PATENT NO. : 4,343,568

DATED : August 10, 1982

INVENTOR(S) : Benno KALTENEGGER

It is certified that error appears in the above—identified patent and that said Letters Patent is hereby corrected as shown below:

On the title page

In the Abstract: lines 6 and 7, delete "specifically".

Column 1, line 7, after "Background" insert a colon;

line 8, change "and" to --are--;

line 16, delete "axle";

line 40, change "a" to --in--.

Col. 3, line 9, delete "up";

lines 22-24, change the sentence to read: --The upper end 5a (FIG. 2) of the shaft 5 is connected for rotation with a driving shaft 29 of a driving motor 30 or the like by a flexible coupling 28.--.

Signed and Sealed this

*Twenty-sixth* Day of *October 1982*

[SEAL]

*Attest:*

GERALD J. MOSSINGHOFF

*Attesting Officer*

*Commissioner of Patents and Trademarks*